United States Patent [19]

Taylor

[11] 4,201,364

[45] May 6, 1980

[54] RADIALLY EXPANDABLE TUBULAR VALVE SEAL

[75] Inventor: Donald F. Taylor, Dallas, Tex.

[73] Assignee: Otis Engineering Corporation, Dallas, Tex.

[21] Appl. No.: 928,362

[22] Filed: Jul. 27, 1978

[51] Int. Cl.[2] ..... F16K 3/18

[52] U.S. Cl. ..... 251/175; 166/332

[58] Field of Search ..... 166/326, 332; 251/175; 137/853

[56] References Cited

U.S. PATENT DOCUMENTS

| | | | |
|---|---|---|---|
| 1,596,049 | 8/1926 | Kienast | 251/175 |
| 2,608,204 | 8/1952 | Dunn | 137/853 |
| 3,103,948 | 9/1963 | Salmen | 251/175 X |
| 3,355,142 | 11/1967 | Kammerer | 251/175 |

*Primary Examiner*—Robert G. Nilson

*Attorney, Agent, or Firm*—Vinson & Elkins

[57] ABSTRACT

Disclosed is a valve to control fluid flow between a region exterior of a tubular member and a region interior of the tubular member. The valve includes a tubular seal element which is radially expandable to prevent flow and is radially contractible upon sliding movement thereof to permit flow and to reduce frictional resistance to such sliding movement.

16 Claims, 8 Drawing Figures

RADIALLY EXPANDABLE TUBULAR VALVE SEAL

BACKGROUND OF THE INVENTION

1. Field of the Invention

This invention relates to a valve for controlling flow between a region exterior of a tubular member and a region interior of a tubular member.

2. The Prior Art

Sleeve valves, such as illustrated on pages 3966 and 3967 of the 1974–75 edition of the "COMPOSITE CATALOG OF OILFIELD EQUIPMENT AND SERVICES" have been utilized to control flow through lateral ports. However, axial movement of the sleeve valve mandrel is resisted by frictional forces between the seals and the housing. For some laterally ported installations, the frictional resistance to axial movement of the sleeve valve mandrel cannot be tolerated. A much more easily movable valve mandrel is required.

Tubular packings, as disclosed in U.S. Pat. Nos. 3,215,208; 3,036,639; and 2,988,148 have been utilized to seal an annulus between concentric pipe and prevent longitudinal fluid flow through the annulus. The tubular packings must be compressed and expanded into engagement with the outer pipe before they are effective to seal off the annulus.

Cup-type packing elements, as disclosed in U.S. Pat. No. 2,988,148, have also been used to seal the annulus between concentric pipe. A cup-type packing element can function as a check valve permitting longitudinal flow through the annulus in one direction and preventing longitudinal flow through the annulus in the other direction. However, a cup-type packing element would quickly loose its sealing capabilities if operated as a sliding valve.

U.S. Pat. No. 2,642,889 and page 3917 of the "COMPOSITE CATALOG OF OIL FIELD EQUIPMENT AND SERVICES", 1970–71 edition disclose a valve having a cup-like packing element to function as a check valve and prevent back flow through a lateral port and a tubular packing element which is radially expandable to prevent flow through the lateral port. Expansion of the tubular packing element is controlled by adjusting the pressure of a confined charge of flow relative to the pressure of fluid against which the packing element is sealing. The higher the pressure against which the disclosed tubular packing element must seal, the weaker the seal. If the pressure against which the disclosed tubular packing element is sealing is greater than the pressure of the charge of fluid, the seal is broken and fluid flow is permitted through the lateral port.

OBJECTS OF THE INVENTION

An object of this invention is to provide a valve for controlling flow through lateral ports and including a single sealing element that is operable as a sliding seal.

Another object of this invention is to provide a valve for controlling flow through lateral ports and including a sealing element which reduces its sealing and frictional engagement during movement of the element towards its open position so that the valve may be more easily opened than has heretofore been possible for sliding valves.

Another object of this invention is to provide a valve in accordance with any one of the above objects wherein a carrier for the valve seal may be shortened upon the application of a relatively small force to assist the seal's expansion into sealing engagement with the valve sealing surface.

These and other objects and features of advantage of this invention will be apparent from the drawings, the detailed description, and the appended claims.

BRIEF DESCRIPTION OF THE DRAWINGS

In the drawings, wherein like numerals indicate like parts, and wherein illustrative embodiments of this invention are shown.

DETAILED DESCRIPTION OF THE PREFERRED EMBODIMENTS

In certain installations, lateral ports are valved to control flow between the interior and exterior of a tubular member.

Figure 1:
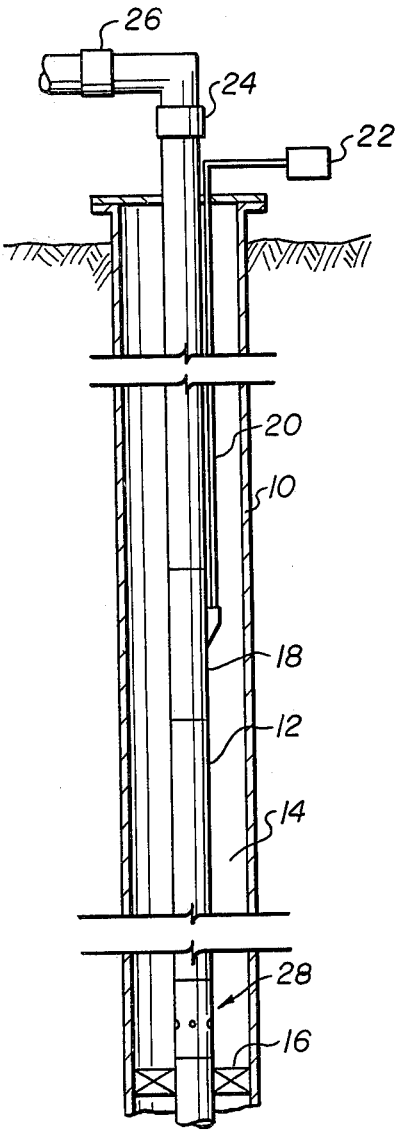
FIG. 1 is a schematic illustration of a well installation incorporating a valve structured in accordance with this invention.

One such installation is the well illustrated schematically in FIG. 1. The well is cased with the usual casing string 10. Through the casing string 10 extends a production tubing string 12. Fluid flow from a producing formation (not shown) is confined to the bore of the tubing string 12 by packing off the annulus 14 between the casing string 10 and the tubing spring 12 with packer means 16. Subsurface safety valve 18 is positioned in the tubing string 12 and controls flow through the tubing string bore at a subsurface location in the well. The subsurface safety valve 18 is in turn controlled from the surface by communicating control fluid thereto through control conduit means 20. At the surface, operating manifold 22 pressurizes and depressurizes the control fluid and pumps it into control conduit means 20. Surface flow through the tubing string 12 is controlled by surface valves 24 and 26.

A circulating device 28 controls fluid flow between the annulus 14 and the tubing string bore. The circulating device 28 is positioned in the tubing string 12 wherever controlled flow between the casing-tubing annulus 14 and the tubing string bore is desired.

Figure 2:
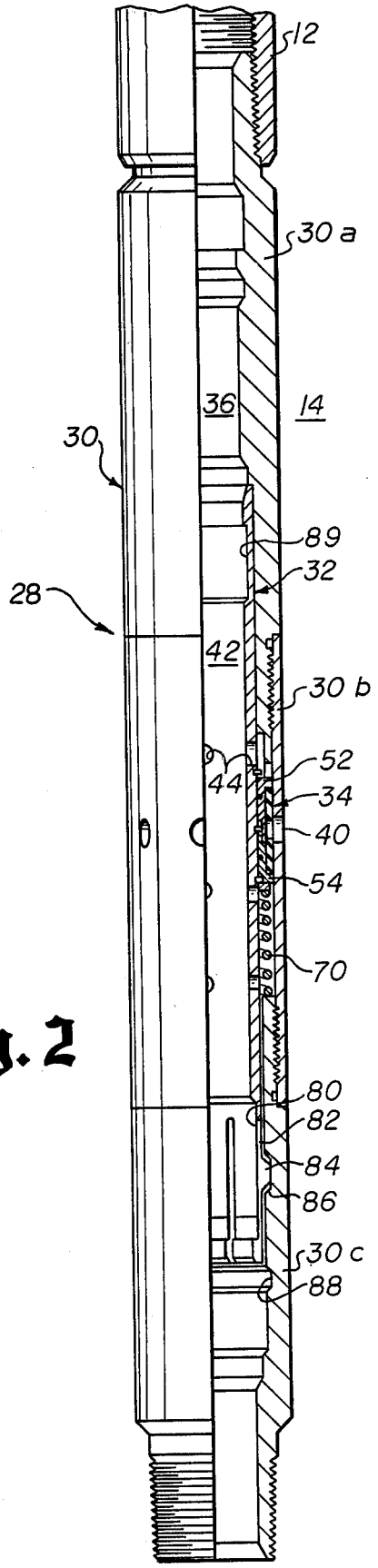
FIG. 2 is a longitudinal quarter-sectional view of a valve structured in accordance with this invention.

A detailed view of a circulating device 28 structured in accordance with this invention is illustrated in FIG. 2. The circulating device 28 includes tubular housing means 30, valve mandrel means 32 and tubular seal means 34. The valving components of the circulating device 28 cooperate to obtain advantages heretofore not obtainable for lateral port valves. In a first position of valve mandrel means 32, flow through the valve is controlled in response to a pressure gradient. Once the valve acts to prevent fluid flow, the force which urges the tubular seal means 34 to its seal effective position is proportional to the pressure against which the valve is sealing. During movement of valve mandrel means 32 from its first position towards its second position, even though while valve mandrel means 32 was in its first position tubular seal means 34 was in its seal effective position and even though the pressure against which the valve was sealing remains constant, the force urging tubular seal means 34 into sealing engagement immediately reduces. Valve mandrel means 32 is therefore moved to its second position much more easily than has heretofore been possible for sleeve valve members. Tubular seal means 34 is elastic and normally contracted onto valve mandrel means 32 and out of sealing engagement. However, tubular seal means 34 may be resiliently urged to an expanded position when valve mandrel means 32 is in its first position. Once valve mandrel means 32 moves a minimal distance from its first position towards its second position, tubular seal means again contracts onto valve mandrel means 32 and thereafter presents no sliding frictional resistance to further movement of valve mandrel means 32.

Figure 3:
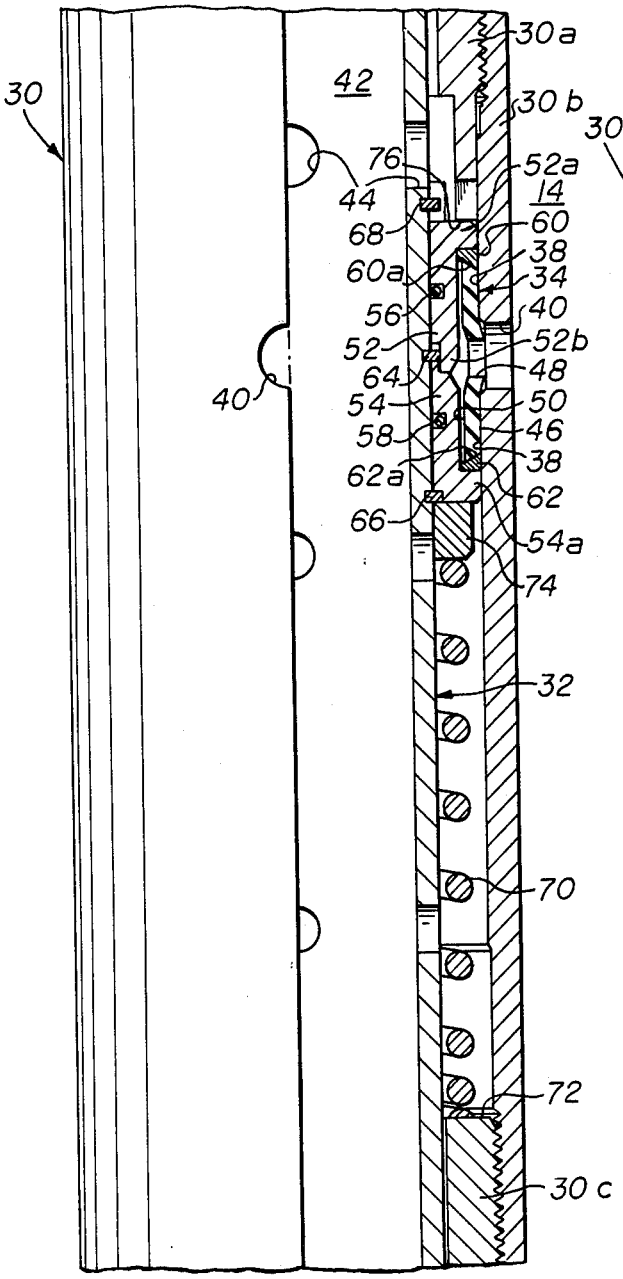
FIG. 3 is a partial and enlarged quarter-sectional view of the valve of FIG. 2 with the valve in the closed position.
Figure 4:
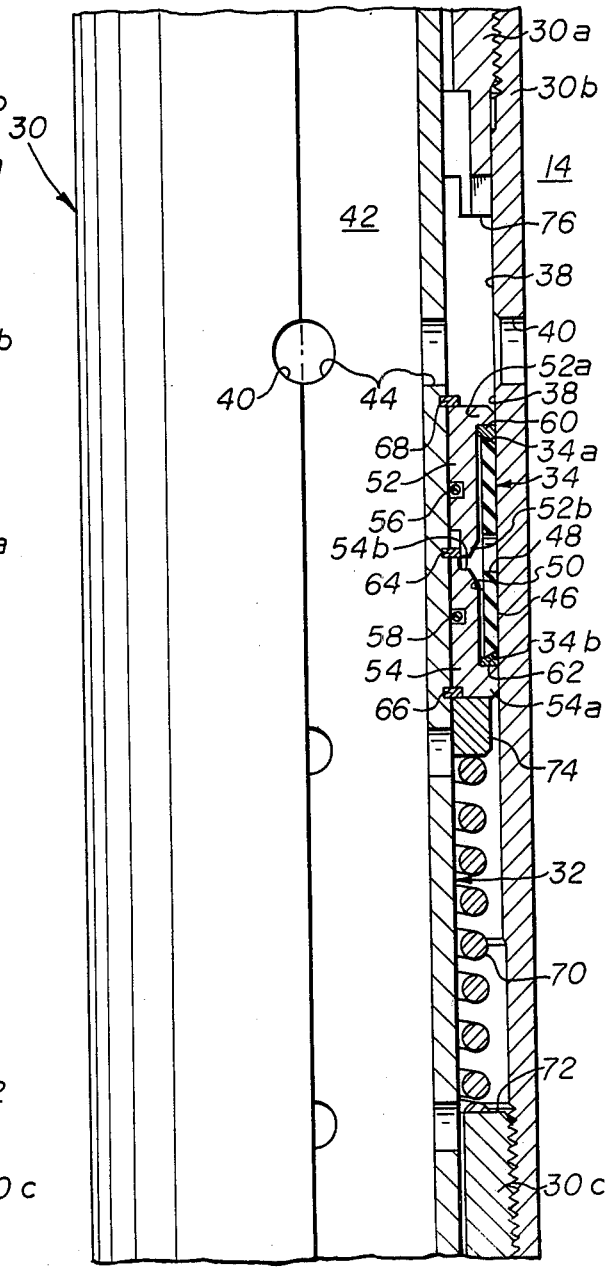
FIG. 4 is a view similar to FIG. 3 with the valve in the open position.

FIGS. 3 and 4 are partial enlarged views of the circulating device 28 of FIG. 2.

Tubular housing means 30 defines two regions. Fluid flow between these two regions is controlled by the valve. For the illustrated application of the valve in a circulating device, one of the regions is the tubing-casing annulus 14. The other region is the longitudinally extending bore means 36 through tubular housing means 30. Bore means 36 communicates with the bore through the tubing string 12. Tubular housing means 30 includes a sealing surface 38 which is engageable by the tubular seal means 34. Depending upon the concentric relationship among the tubular housing means 30, valve mandrel means 32 and tubular seal means 34, the sealing surface 38 could face either one of the two regions 14 and 36. For the illustrated circulating device 28, the sealing surface 38 of tubular housing means 30 faces the inner region 36. Lateral port means 40 open in the sealing surface 38, extend laterally through tubular housing means 30 and extend between the two regions 14 and 36. Fluid flow between the two regions 14 and 36 is controlled in the circulating device 28 by controlling flow through lateral port means 40. The illustrated tubular housing means 30 is formed from inter-connected tubular sections 30*a*, 30*b* and 30*c*.

Valve mandrel means 32 carries tubular seal means 34, extends along the sealing surface 38 and is movable with respect to tubular housing means 30 between a first position (see FIGS. 2 and 3) and a second position (see FIG. 4). In the first position of valve mandrel means 32, tubular seal means 34 is movable into sealing engagement with the sealing surface 38. When valve mandrel means 32 is in its second position, tubular seal means 34 does not affect flow through lateral port means 40.

The illustrated valve mandrel means 32 is tubular and includes an interior bore 42 aligned with and in fluid communication with bore means 36 extending through tubular housing means 30. To perform various operations in the well, well equipment may be run through the longitudinally extending bore means 36 of tubular housing means 30 and the interior bore 42 of valve mandrel means 32. A substantially unobstructed flow path between the exterior annulus region 14 and the interior region 36 is obtained when valve mandrel means 32 is in its second position through the provision of laterally extending aperture means 44 in valve mandrel means 32. The aperture means 44 are preferably substantially longitudinally aligned with port means 40 when valve mandrel means 32 is in its second position. However, the annular cross-sectional area between valve mandrel means 32 and housing means 30 is greater than the flow area of port means 40 and/or aperture means 44 so that longitudinal alignment between port means 40 and aperture means 44 is unnecessary.

Tubular seal means 34 is expandable into sealing contact with sealing surface 38 to prevent fluid flow through lateral port means 40 when valve mandrel means 32 is in its first position and quickly contracts away from sealing surface 38 during movement of valve mandrel means from its first position towards its second position to reduce frictional resistance to movement of valve mandrel means 32. Valve mandrel means 32 carries tubular seal means 34. The longitudinal ends 34*a* and 34*b* of tubular seal means are reinforced to prevent their extrusion away from valve mandrel means 32 and are sealingly carried around valve mandrel means 32. In other words, fluid flow between either end 34*a* or 34*b* of tubular seal means 34 and valve mandrel means 32 is prevented. The mid-portion of tubular seal means 34 expands radially outwardly into sealing engagement with the sealing surface 38 to prevent flow through port means 40. Preferably, tubular seal means is inherently contractable radially away from the sealing surface 38. When it is relaxed tubular seal means 34 is spaced from sealing surface 38. The tendency of tubular seal means 34 to assume a relaxed configuration radially spaced from sealing surface 38 reduces frictional forces between tubular seal means 34 and housing means 30 during movement of valve mandrel means 32 from its first position towards its second position and protects the outer surface 46 of tubular seal means 34 during such movement of valve mandrel means 32. When valve mandrel means 32 is in its first position, tubular seal means 34 spans lateral port means 40 longitudinally. One end 34*a* of tubular seal means 34 is on one side (e.g., longitudinally above) of port means 40 while the other end 34*b* of tubular seal means 34 is on the other side (e.g., longitudinally below) of port means 40. When valve mandrel means 32 is in its second position, tubular seal means 34 is spaced longitudinally from port means 40 and does not affect flow through port means 40. Tubular seal means 34 may be any flexible, reinforced material possessing elastic properties and capable of partial recovery from a radial expanded position to a normal relaxed position.

Pressure responsive means is formed between tubular seal means 34 and valve mandrel means 32. The pressure responsive means is effective only when valve mandrel means 32 is in its first position. Whenever the pressure gradient between the exterior region 14 and the interior region 36 attains a minimal value, the pressure responsive means expands tubular seal means 34 into sealing engagement with the sealing surface 38. As long as the pressure gradient remains above that minimal value and as long as valve mandrel means 32 remains in its first position, the pressure responsive means will maintain tubular seal means 34 in expanded position. Tubular seal means 34 sealingly engages sealing surface 38 and flow through lateral port means 40 is prevented.

The tubular seal means 34 includes orifice means 48 extending laterally therethrough at substantially the mid point thereof for admitting fluid into the pressure responsive means from the one, exterior pressure region 14. When valve mandrel means 36 is in its first position, orifice means 48 is substantially longitudinally aligned with port means 40.

Whenever there is a pressure differential from the one annular region 14 to the other interior region 36, fluids flow from the annulus 14 to the bore 36 through port means 40. When valve mandrel means 32 is in its second position, the annular flow area between housing means 30 and valve mandrel means 32 is greater than the flow area through port means 40. However, when valve mandrel means 32 is in its first position the annular flow area between the outer surface 46 of the tubular seal means 34 and the sealing surface 38 of housing means 30 is less than the flow area through port means 40. Therefore, any fluid flow around the outer surface 46 of tubular seal means 34 will increase the pressure gradient between the sensed fluid pressure in the annular region 14 and the sensed fluid pressure in the interior region 36. While valve mandrel means 32 is in its first position, the sensed fluid pressure in the annular region 14 is effective within the pressure responsive means because orifice means 48 admits fluids flowing through port means 40 from the annulus 14 directly thereto. At the same time, the sensed fluid pressure of the interior region 36 acts upon the outer surface 46 of tubular seal means 34. Thus, a pressure differential is created across tubular seal means 34. That pressure differential tends to expand tubular seal means 34 radially outwardly.

Figure 7:
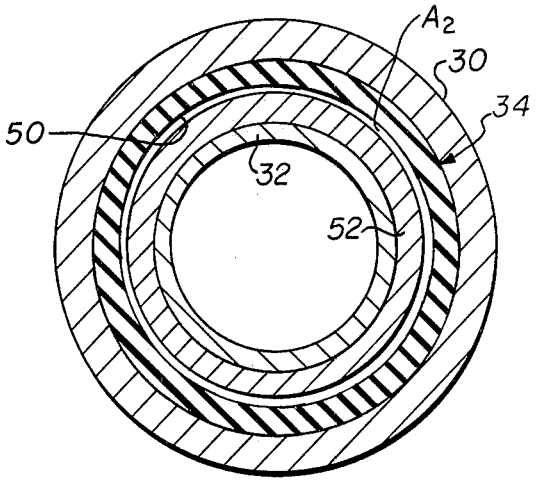
FIG. 7 is a sectional view taken along line 7—7 of FIG. 5.
Figure 5:
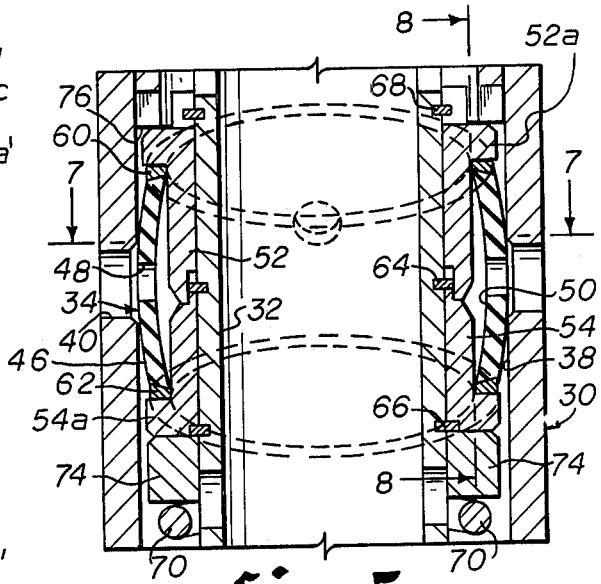
FIG. 5 is a partial sectional view of the valve of FIGS. 2 through 4 with the relative position of certain components exaggerated.
Figure 8:
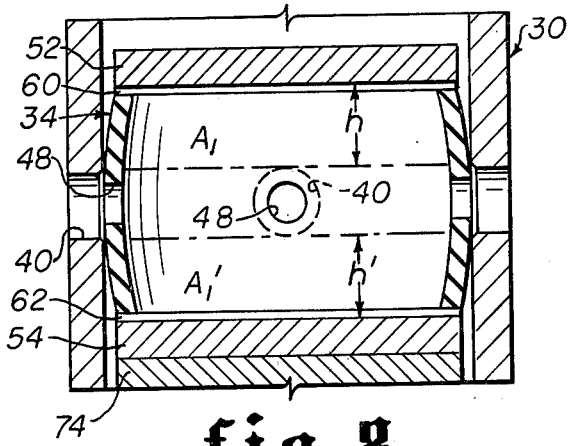
FIG. 8 is a view taken along line 8—8 of FIG. 5.

Whether or not tubular seal means 34 sealingly engages the sealing surface 38 is dependent upon valve mandrel means 32 being in its first position, the magnitude of the pressure gradient between the two regions 14 and 36, the elastic properties of tubular seal means 34 and the relative size of the pressure responsive areas upon which the pressure gradient acts. The pressure responsive means defines three pressure responsive areas which are shown in FIGS. 7 and 8. FIG. 5 shows where the views of FIGS. 7 and 8 are taken. The relative size and position of components of the valve are exaggerated in FIGS. 5, 7 and 8 to more clearly illustrate the pressure responsive areas. Two cylindrical areas $A_1$ and $A_1'$ are formed when valve mandrel means 32 is in its first position (see FIG. 8). The diameter of each cylindrical area $A_1$ and $A_1'$ is equal to the internal diameter of the inner surface 50 of tubular seal means 34. The height h and h' of each cylindrical area $A_1$ and $A_1'$ is equal to the distance between the respective extreme end of tubular seal means 34 and the closer of port means 40 and orifice means 48. Each cylindrical area $A_1$ and $A_1'$ is equal to the circumference of the internal wall 50 of tubular seal means 34 times its respective height h or h'. Any movement of valve mandrel means 32 from its first position will vary heights h and h' defining cylindrical areas $A_1$ and $A_1'$. For example, during movement of valve mandrel means 32 from its first position towards its second position, port means 40 remains stationary and the one end 34*a* of tubular seal means moves longitudinally towards port means 40. The height h of the one upper cylindrical area $A_1$ decreases. The decreasing height h correspondingly reduces that cylindrical area $A_1$. As the upper end 34*a* of tubular seal means 34 passes port means 40, the cylindrical area $A_1$ becomes zero. The other cylindrical area $A_1'$ attains its maximum size when orifice means 48 passes port means 40. That cylindrical area $A_1'$ remains at its maximum size with its height h' equal to the distance between orifice means 48 and the bottom end 34*b* of tubular seal means 34. The third pressure responsive area is an annular area $A_2$ (see FIG. 7). The annular area $A_2$ is the projected annular area between the interior wall 50 of tubular seal means 34 when tubular seal means 34 is relaxed and the interior wall 50 of tubular seal means 34 when tubular seal means 34 is expanded.

When valve mandrel means 32 is in its first position, the total of the two cylindrical pressure responsive areas $A_1$ and $A_1'$ is maximized. If tubular seal means 34 is relaxed, the annular pressure responsive area $A_2$ is minimized and equals zero. A pressure gradient between the exterior region 14 and the interior region 36, with the exterior region having the higher pressure, tends to expand tubular seal means 34 radially outwardly. The exterior fluid pressure, upon being admitted to the pressure responsive means through orifice means 48 will be effective over the cylindrical pressure responsive areas $A_1$ and $A_1'$ and will create a force tending to expand tubular seal means 34 radially outwardly. When the pressure gradient is below a minimal amount, the pressure acting across the cylindrical areas $A_1$ and $A_1'$ will be insufficient to force tubular seal means 34 into sealing engagement with the sealing surface 38. Moreover, as a design limitation, regardless of the magnitude of the pressure gradient, the sum of the cylindrical areas $A_1$ and $A_1'$ must be greater than the annular area $A_2$ to enable tubular seal means 34 to assume its seal effective position. In other words, if the radial distance between the outer surface 46 of tubular seal means 34 and the sealing surface 38 is too great and if the longitudinal distance between the ends 34*a* and 34*b* of tubular seal means 34 is too small, an effective seal cannot be obtained. If tubular seal means 34 is sized within limits that will yield a proper relationship among the cylindrical areas $A_1$ and $A_1'$ and the annular area $A_2$, whenever the pressure gradient exceeds a minimal amount, the external pressure acting across the cylindrical pressure areas $A_1$ and $A_2$ will force tubular seal means 34 into sealing engagement with the sealing surface 38. Thereafter, any increase in the pressure gradient will increase the force urging tubular seal means 34 into sealing engagement with the sealing surface 38.

Movement of valve mandrel means 32 from its first position towards its second position reduces the pressure force urging tubular seal means 34 into sealing engagement with sealing surface 38. The pressure force reduces because the sum of the pressure responsive cylindrical areas $A_1$ and $A_1'$ is being reduced. The upper cylindrical area $A_1$ is being reduced because its height h is reducing. The lower cylindrical area $A_1'$ becomes fixed in size. Depending upon the elastic properties of tubular seal means 34, and at least when the sum of the cylindrical pressure responsive areas $A_1$ and $A_1'$ becomes substantially equal to the projected annular pressure responsive area $A_2$, the force urging tubular seal means 34 into sealing engagement with sealing surface 38 reduces below that required to maintain a sealing engagement between tubular seal means and the sealing surface 38. Upon further movement of valve mandrel means 32 and a further reduction in the total cylindrical pressure responsive areas $A_1$ and $A_1'$, tubular seal means 34 collapses. Once collapsed, it no longer engages tubular housing means 30. Valve mandrel means 32 is able to move to its second position without frictional forces between tubular seal means 34 and valve mandrel means 38 retarding such movement.

Tubular seal means 34 is carried on valve mandrel means 32 in a manner to form the pressure responsive means therebetween and to permit relative movement between the extreme ends 34*a* and 34*b* of tubular seal means 34. Relative movement of the ends 34*a* and 34*b* of tubular seal means 34 towards each other assists in the outward radial expansion of tubular seal means 34. Relative movement of the ends away from each other assists in the radial contraction of tubular seal means 34. That relative movement preferably occurs with little frictional drag.

Tubular seal means 34 is carried on valve mandrel means 32 by two carrier sleeve means 52 and 54. One end 34*a* of tubular seal means 34 is associated with one carrier sleeve means 52 and the other end 34*b* of tubular seal means 34 is associated with the other carrier sleeve means 54. The mounting arrangement of the carrier sleeve means 52 and 54 on valve mandrel means 32 and the association of each end 34*a* and 34*b* of tubular seal means 34 with the carrier sleeve means 52 and 54, respectively, forms the pressure responsive means. Seal means 56 seals between carrier sleeve means 52 and valve mandrel means 32 and prevents fluid flow therebetween. In a similar manner, seal means 58 seals between carrier sleeve means 54 and valve mandrel means 32. The seal means 56 and 58 are essentially static seals. They maintain the integrity of the pressure responsive means and prevent fluid communication between the pressure responsive means and the pressure region 36 interior of tubular housing means 30. Fluid flow between each end 34*a* and 34*b* of tubular seal means 34 and the respective carrier sleeve means 52 and 54 with which it is associated is also prevented. In other words, one end 34*a* of tubular seal means 34 is sealed to carrier sleeve means 52 and the other end 34*b* is sealed to carrier sleeve means 54. Preferably, each end 34*a* and 34*b* of tubular seal means 34 is reinforced to prevent their extrusion off of the respective carrier sleeve means 52 and 54 upon which each is sealingly carried. For the embodiment illustrated in FIGS. 2, 3, 4, 5, 7 and 8, antiextrusion ring means 60 and 62 are secured to each end 34*a* and 34*b*, respectively, of the tubular seal means 34. The antiextrusion ring means 60 and 62 may be formed from material similar to the material forming tubular seal means 34 except that the material forming anti-extrusion ring means 60 and 62 is denser and harder than the material forming tubular seal means 34. Each anti-extrusion ring means 60 and 62 is configured so that upon any radial outward expansion of tubular seal means 34, tubular seal means contracts longitudinally and so that upon any longitudinal contraction of tubular seal means 34 it expands radially outwardly. Each anti-extrusion ring means 60 and 62 includes a skewed surface 60*a* and 62*a*, respectively. The skewed surfaces 60*a* and 62*a* face each other. Movement of the cam ring means 60 and 62 towards each other imparts a skewed compressive force to tubular seal means 34 and assists the radially outward expansion of the mid section thereof and prevents extrusion of each longitudinal end thereof. Each anti-extrusion ring means 60 and 62 may be bonded to the respective carrier sleeve means 52 and 54 upon which it is mounted and each may be bonded to tubular seal means 34.

The carrier sleeve means 52 and 54 are configured so that upon relative movement between the two sleeve means 52 and 54 towards each other the tubular seal means 34 is confined longitudinally and contracted longitudinally. Each carrier sleeve means 52 and 54 includes an annular flange 52*a* and 54*a*, respectively. The extent to which the carrier sleeve means 52 and 54 can move longitudinally away from each other is adjusted so that when tubular seal means 34 is relaxed and has its greatest longitudinal length, the annular flanges 52*a* and 52*b* are spaced apart a distance equal to the longitudinal length of tubular seal means 34 plus longitudinal length of the anti-extrusion ring means 60 and 62. Thus any relative movement of the two carrier sleeve means 52 and 54 towards each other will longitudinally compress and radially expand tubular seal means 34.

Relative movement between the carrier sleeve means 52 and 54 is attained by fixing one of the two carrier sleeve means 52 and 54 with respect to valve mandrel means 32 and permitting the other to undergo limited longitudinal movement with respect to valve mandrel means 32. In the illustrated circulating device 28, carrier sleeve means 54 is fixed relative to valve mandrel means 32. Two stop ring means 64 and 66 are carried on valve mandrel means 32. Carrier sleeve means 54 is confined against longitudinal movement relative to valve mandrel means 32 by the two stop ring means 64 and 66. A third stop ring means 68 prevents extreme longitudinal movement of the other carrier sleeve means 52 in a first longitudinal direction. Carrier sleeve means 52 includes a nose 52*b* which slides by the one stop ring means 64 and engages a shoulder 54*b* of carrier sleeve means 54 upon longitudinal movement of carrier sleeve means 52 in the other direction. Carrier sleeve means 52 may thus undergo limited longitudinal movement with respect to valve mandrel means 32 and thus with respect to the other carrier sleeve means 54 between stop ring means 68 and shoulder 54*b* on carrier sleeve means 54.

When valve mandrel means 32 is in its first position, the carrier sleeve means 52 and 54 are resiliently urged towards each other. Such resilient urging imparts a longitudinal compressive force to tubular seal means 34 and thus contributes to the radially outward expansion thereof. However, once valve mandrel means 32 moves a slight distance from its first position towards its second position, the carrier sleeve means 52 and 54 are no longer resiliently urged towards each other. Tubular seal means 34 is no longer subject to a longitudinally compressive force. The forces urging tubular seal means 34 radially outwardly are therefore reduced. To resiliently urge the carrier sleeve means 52 and 54 towards each other, yieldable means 70 urges valve mandrel means 32 towards its first position. The yieldable urging means 70 may comprise a coil compression spring between a stop shoulder 72 formed on valve housing means 30 and a stop ring 74 carried by valve mandrel means 32. Stop means 76 associated with valve housing means 30 engages the one carrier sleeve means 52 before valve mandrel means 32 assumes its first position. The spaced relationship among stop means 76, carrier sleeve means 52, carrier sleeve means 54, and valve mandrel means 32 is such that prior to valve mandrel means 32 reaching its first position, carrier sleeve means 52 engages stop means 76 and becomes stopped with respect to valve housing means 30. Upon further movement of valve mandrel means 32 towards its first position, carrier sleeve means 54, being fixed with respect to valve mandrel means 32, is pushed towards the stopped carrier sleeve means 52. Valve mandrel means attains its first position and relative movement of carrier sleeve means 54 towards carrier sleeve means 52 ceases when nose 52*b* engages shoulder 54*b*. Slight movement of valve mandrel means 32 from its first position towards its second position first results in carrier sleeve means 54 moving longitudinally away from carrier sleeve means 52 and continued movement results in carrier sleeve means 52 becoming spaced from stop means 76. The resilient urging means, although still applying a force to stop ring 74, is no longer effective to move the carrier sleeve means 52 and 54 towards each other.

Thus, spring means 70 performs the dual functions of resiliently urging the two carrier sleeve means 52 and 54 longitudinally towards each other while valve mandrel means 32 is in its first position and of continuously resiliently urging valve mandrel means 32 towards its first position.

The circulating device 28 is structured to permit controlled movement of valve mandrel means 32 between its first and second positions.

The lower inwardly facing recess 80 of the valve mandrel means 32 is configured to receive locating key means of an operating tool. The operating tool may be the "TYPE B OTIS POSITIONING TOOL" illustrated on page 3968 of the 1974–75 "COMPOSITE CATALOG OF OILFIELD EQUIPMENT AND SERVICES".

The circulating device 28 also includes means for releasably maintaining the valve mandrel means 32 in one of its first and second positions. Valve mandrel means 32 includes downwardly depending and radially outwardly expanding collet fingers 82. The collet fingers 82 include an outwardly facing boss 84. The lower tubular section 30*c* has two spaced inwardly facing lock recess means 86 and 88. The one lock recess means 86 is positioned to receive the boss 84 of the outwardly expandable collet fingers 82 when valve mandrel means 32 is in its first position. The other lock recess means 88 is positioned to receive the boss 84 when valve mandrel means 32 is in its second position. The engagement of the boss 84 within one of the lock recess means 86 and 84 releasably maintains valve mandrel means 32 in one of its first and second positions until valve mandrel means 32 is shifted by the operating tool.

In operation, the valve of this invention is utilized to control flow between a region exterior of a tubular member and a region interior of a tubular member. One of the specific uses for such a valve is in a circulating device 28 in a well. The illustrated circulating device 28 is constructed so that the valve selectively prevents flow from the casing-tubing annulus 14 exterior of tubular valve housing means 30 to the bore 36 interior of tubing housing means 30.

When valve mandrel means 32 is in its first position (see FIGS. 2 and 3) fluid flow may be prevented.

When the pressure of fluid within the inner region 36 is higher than the pressure of fluid within the outer region 14, the valve permits flow through lateral port means 40. Fluids would flow from the longitudinally extending bore 36 to the casing-tubing annulus 14. The primary flow path through the valve would be through aperture means 44, around the outer surface 46 of tubular seal means 34 and between the sealing surface 38, and through lateral extending port means 40. Even if carrier sleeve means 52 and 54 are resiliently urged towards each other to thereby exert an outwardly expanding force on tubular sleeve means 34, the pressure force within the pressure responsive means, being substantially equal to the pressure in the exterior annulus 14, will be unable to maintain tubular seal means 34 in sealing engagement with the sealing surface 38.

Upon reversal of the pressure gradient so that the exterior annulus region 14 has the higher pressure, the pressure responsive means will urge tubular seal means 34 towards its expanded and sealing position. Even though the exterior annulus region 14 has the higher pressure, if the pressure differential is below a minimal value, tubular seal means 34 will not sealingly engage sealing surface 38. A relatively low rate of fluid flow from the exterior annulus region 14 to the interior bore 36 will be permitted. The flow path from the exterior annulus region to the interior bore 36 will be through the lateral extending port means 40, around the exterior surface 46 of tubular seal means 34 and through aperture means 44.

Whenever the pressure differential between the exterior annulus region 14 and the interior bore 36 exceeds a minimal value, tubular seal means 34 is expanded into sealing engagement with the sealing surface 38. Fluid pressure from the exterior annulus region 14 communicates to the pressure responsive means through port means 40 and orifice means 48. The pressure of fluid within the pressure responsive means acts across the two cylindrical pressure responsive areas $A_1$ and $A_1'$ and urges tubular seal means 34 radially outwardly. Because the two carrier sleeve means 52 and 54 are resiliently urged towards each other, the longitudinally confining annular flanges 52*a* and 54*a* longitudinally shorten tubular seal means 34 and thereby urge tubular seal means 34 radially outwardly. Tubular seal means 34 engages the sealing surface 38 and effects a seal therewith. Thereafter, as long as the pressure gradient between the exterior region 14 and the interior region 36 remains above a minimal value, tubular seal means 34 will remain in sealing engagement with the sealing surface 38. The tubular seal means 34 is urged radially outwardly by the very pressure against which it seals. Thus, the higher the pressure differential from the exterior region 14 to the interior region 36, the greater is the force urging tubular seal means 34 into sealing engagement with sealing surface 38.

If it is desired to open the lateral port means 40 of the circulating device 28, even though a higher pressure differential exists between the exterior pressure region 14 and the interior bore 36, valve mandrel means 32 is shifted from its first position to its second position. Until valve mandrel means 32 is so shifted, the engagement of collet boss 84 within the first lock recess means 86 maintains valve mandrel means 32 in its first position.

To shift valve mandrel means 32 to its second position, an operating tool is utilized. The operating tool may be the aforementioned "OTIS TYPE B POSITIONING TOOL". The operating tool is landed in the inwardly facing recess 80. It is jarred to move valve mandrel means 32 from its first position towards its second position. During the initial movement of valve mandrel means 32 from its first position towards its second position, two of the forces which urge tubular seal means 34 radially outwardly are reduced. Movement of valve mandrel means 32 reduces the height h of the cylindrical pressure responsive area $A_1$ of the pressure responsive means. The cylindrical pressure responsive area $A_1$ reduces. Consequently, the pressure force urging tubular seal means 34 radially outwardly reduces. Additionally, movement of valve mandrel means 32 spaces carrier sleeve means 52 from stop means 76 and renders the yieldable urging means 70 ineffective to yieldably urge the two carrier sleeve means 52 and 54 towards each other. The valve mandrel means 32 is moved towards its second position against the force of the yieldable urging means 70. Carrier sleeve means 52 may move relative to valve mandrel means 32 and carrier sleeve means 54 until it contacts stop ring means 68. Carrier sleeve means then moves downwardly with valve mandrel means 32 and becomes spaced from stop means 76. Relative movement between carrier sleeve means 52 and 54 is thereafter not affected by yieldable urging means 70. Tubular seal means 34 is able to extend longitudinally to its fully relaxed position.

Once valve mandrel means 32 has moved a minimal distance from its first position towards its second position, the height h of the cylindrical area $A_1$ will be reduced substantially. The size of the cylindrical pressure responsive area $A_1$ approaches the size of the annular pressure responsive area $A_2$. The ability of the pressure responsive means to urge tubular seal means 34 radially outwardly rapidly diminishes. The elasticity of tubular seal means 34 causes tubular seal means 34 to contract away from and disengage from sealing surface 38. Fluid flow through the valve is permitted. Tubular seal means 34 assumes its relaxed configuration. Thereafter, due to the disengagement of tubular seal means 34 from the sealing surface 38, valve mandrel means 32 moves to its second position with no frictional engagement between tubular seal means 34 and the sealing surface 38.

Thus, frictional forces affecting sealing components of the valve are substantially reduced. The frictional forces that do affect sealing components are relatively minor. There will be some frictional force between seal means 56 and valve means 32 due to the relative movement between valve mandrel means 32 and carrier sleeve means 52. Since that amount of relative longitudinal movement is small, the frictional forces are also small. Additionally, that frictional force will not affect relative movement of valve mandrel means 32 with respect to tubular housing means 30. An additional frictional force exists between tubular seal means 34 and the valve housing means 30 during movement of valve mandrel means 32 prior to tubular seal means 34 returning to its relaxed configuration. However, since during that movement of valve mandrel means 32 the cylindrical pressure responsive area $A_1$ is reducing and the force longitudinally compressing tubular seal means 34 is reducing, the frictional force correspondingly reduces. After minimal movement of valve mandrel means 32 towards its second position, tubular seal means 34 disengages from the sealing surface 38 and that frictional force becomes zero. Thus, frictional forces affecting sealing components rapidly decrease during movement of valve mandrel means 32 and eventually become zero throughout the major portion of the movement of valve mandrel means 32.

Once valve mandrel means 32 reaches its second position, the boss 84 of collet finger means 82 will snap outwardly into lock recess means 88. Valve mandrel means 32 will thereafter be releasably locked in its second position. Fluids may flow through lateral port means 40 and aperture means 44 substantially unrestricted regardless of the pressure differential between the interior region 36 and the exterior annulus region 14.

Valve mandrel means 34 may be returned to its first position by another operation of an operating tool. The operating tool engages an inwardly facing recess 89 in the upper end of valve mandrel means 32. An upward application of force to the operating tool snaps the collet boss 84 out of lock recess 88. Valve mandrel means 32 is free to move longitudinally upwardly. Spring means 70 may push valve mandrel means 32 upwardly and/or an upward pull on the operating to may lift valve mandrel means 32 upwardly.

Valve mandrel means 32 returns to its first position. The valve thereafter operates to control flow through lateral port means 40 as previously described.

Figure 6:
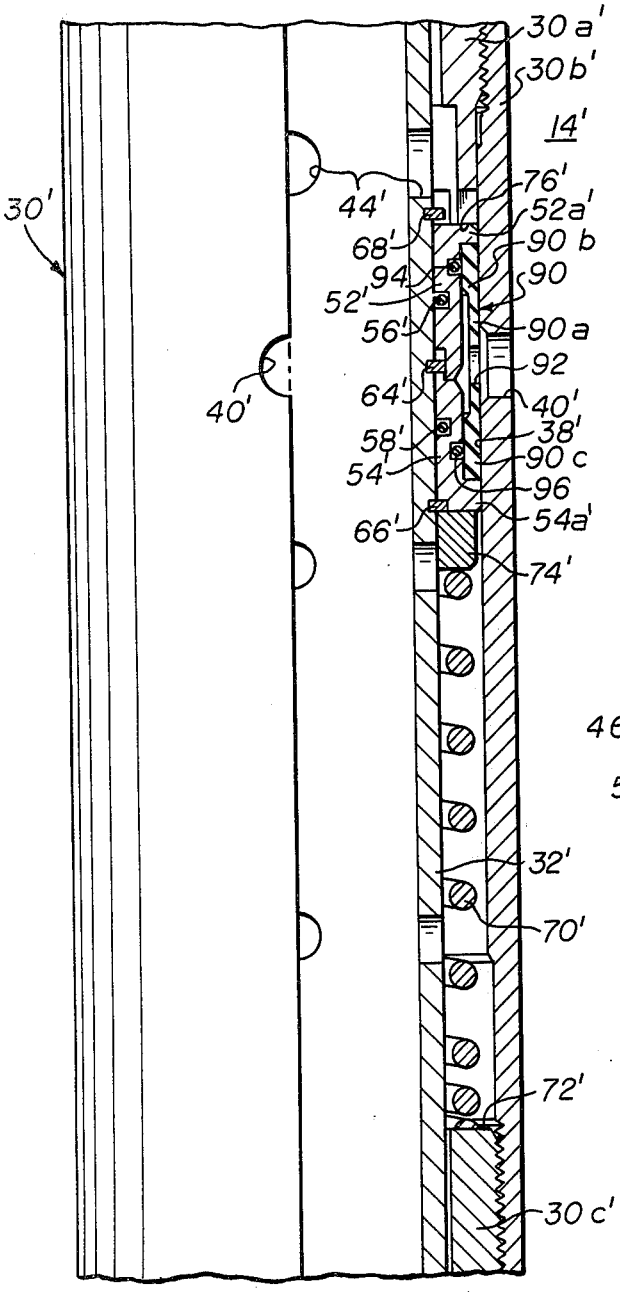
FIG. 6 is a view similar to FIG. 3 of another form of a valve structured in accordance with this invention.

FIG. 6 is a partial view similar to FIG. 3 of another form of the valve structured in accordance with this invention. This second form of a valve is structured similar to the first form except for the tubular seal means 90 and the manner in which it is sealingly carried on the valve mandrel means 32'. Components of this second form of a valve which are structured similar to components of the first form are identified with corresponding numerals except for the addition of a '.

The tubular seal means 90 for this second form of a valve has a reduced wall thickness in its mid section **90*a* and has an enlarged wall thickness for its end sections 90*b* and 90*c*. The reduced walled mid section 90*a* permits that mid section to expand radially outwardly under the action of fluid pressure within the pressure responsive means and when the carrier sleeve means 52' and 54' are moved towards each other. Orifice means 92 admits fluid to the pressure responsive means from the one pressure region 14 exterior of the tubular housing means 30' when the valve mandrel means 32'** is in its first position.

For this form of a valve, the tubular seal means 90 is not adhered to the carrier sleeve means 52' and 54' by bonding or other techniques. Instead, the enlarged end sections **90*b* and 90*c* are formed to prevent extrusion of the tubular seal means 90 off of either of the carrier sleeve means 52' and 54'**.

To maintain the integrity of the pressure responsive means and prevent fluid communication between the tubular seal means and each of the carrier sleeve means 52' and 54', seal means 94 and 96 seal between the tubular sleeve means 90 and the carrier sleeve means 52' and 54', respectively.

The operation of this second form of a valve is similar to the operation of the first form of a valve.

When the valve mandrel means 32' is in its first position, flow through the lateral port means 40' is permitted and pevented, depending upon the pressure gradient between the exterior pressure region 14' and the interior region 36'.

When the interior pressure region 36' has fluid at a higher pressure than the exterior region 14', flow is permitted. When the exterior region 14' has a higher fluid pressure than the interior region 36', but the pressure gradient is below a minimal value, flow is also permitted. However, when the exterior region 14' has a higher pressure than the interior region 36' and the pressure gradient is higher than a minimal value, flow is prevented. Fluids from the exterior pressure region will enter the pressure responsive means through orifice means 92. Once within the pressure responsive means, the high pressure fluids will exert a radially outwardly urging force on tubular seal means 90. The mid section **90*a* of tubular seal means 90 will expand outwardly and engage the sealing surface 38' of tubular housing means 30'. The mid section 90*a* of tubular seal means 90 will also be urged radially outwardly due to the action of the yieldable urging means 70'. Flow through the laterally extending port means 40'** will thereby be prevented.

If desired, valve mandrel means may be moved to its second position. Once so moved, flow through lateral port means 40' will be permitted regardless of the pressure gradient between the exterior pressure region 14' and the interior pressure region 36'. During the initial stages of movement of valve mandrel means 32' from its first position to its second position, the sealing engagement of tubular seal means 90 with sealing surface 38' quickly reduces as tubular seal means 90 moves past lateral port means 40'. Therefore, the frictional forces retarding movement of valve mandrel means 32' also quickly reduces. After a certain minimal movement of valve mandrel means 32' from its first position towards its second position, the pressure responsive means is no longer able to maintain tubular seal means 90 expanded radially outwardly. Tubular seal means 90 relaxes. In its relaxed configuration, tubular seal means 90 does not engage the sealing surface 38'. Valve mandrel means 32' thereafter completes its movement towards its second position without any frictional engagement of tubular seal means 90 with other components of the valve.

After valve mandrel means 32' has been moved to its second position, it may be returned to its first position whenever desired.

From the foregoing, it can be seen that the objects of this invention have been obtained. A valve for controlling flow through lateral ports between the interior and exterior of a tubular member has been provided. The valve may function as a check valve. Flow in one direction through the lateral ports is permitted. Minimal flow in the other direction is also permitted. However, upon a specified pressure differential being obtained, flow in that other direction is prevented. The force urging the sealing member of the valve into sealing engagement with the sealing surface is proportional to the pressure against which the valve is sealing. The valve may also function as a sliding valve. A valve mandrel moves between a first position wherein the seal is permitted to block flow and a second position wherein flow is substantially unrestricted. During movement of the valve mandrel, the seaing engagement of the seal reduces. Throughout a major portion of the valve mandrel movement, the seal is in a relaxed configuration and does not engage the sealing surface. Frictional resistance affecting sealing components of the valve is thereby greatly reduced. Movement of the valve mandrel occurs much more easily than has heretofore been possible and the seal is not subjected to the abrasive affects of continual contact with the sealing surface.

The foregoing disclosure and description of this invention is illustrative and explanatory thereof. Various changes in the size, shape, and materials, as well as the details of the illustrated construction, may be made within the scope of the appended claims without departing from the spirit of the invention.

What is claimed is:

1. A valve comprising:

tubular housing means for defining two regions;

said tubular housing means including a sealing surface facing one of said two regions;

said tubular housing means including lateral port means extending between said two regions and opening in said sealing surface;

mandrel means extending along said sealing surface;

tubular seal means carried by said mandrel means and expandable into engagement with said sealing surface and contractable away from said sealing surface;

said tubular seal means having one longitudinal extreme end on one side of said lateral port means and having its other longitudinal extreme end on the other side of said lateral port means;

pressure responsive means for expanding said tubular seal means into engagement with said sealing surface and formed between said mandrel means and said tubular seal means;

said tubular seal means including means for admitting fluid into said pressure responsive means from the other of said two pressure regions.

2. The valve of claim 1 additionally including:

carrier means for carrying said tubular seal means on said valve mandrel means comprising:

first carrier sleeve means mounted on said mandrel means, and second carrier sleeve means mounted on said mandrel means;

wherein one longitudinal extreme end of said tubular seal means is mounted on one of said first and said second carrier sleeve means and the other longitudinal extreme end of said tubular seal means is mounted on the other of said first and said second carrier sleeve means.

3. The valve of claim 2 wherein:

one of said first and said second carrier sleeve means is fixed relative to said valve mandrel means;

the other of said first and said second carrier sleeve means is movable longitudinally with respect to said valve mandrel means;

additionally including means for resiliently urging said first and said second carrier sleeve means towards each other.

4. The valve of claim 2 additionally including:

anti-extrusion ring means secured to each of said one and said other extreme longitudinal end of said tubular seal means, each of said anti-extrusion ring means including a skewed surface for preventing extrusion of said tubular seal means off of said carrier sleeve means during relative movement of said first and second carrier sleeve means.

5. The valve of claim 2 wherein:

said tubular seal means includes a reduced walled mid section, two enlarged walled end sections and orifice means in said mid section for admitting fluid into said pressure responsive means;

one of said two enlarged walled end sections is mounted around one of said first and said second carrier sleeve means and the other of said two enlarged walled end sections is mounted on the other of said first and said second carrier sleeve means; and additionally including seal means for sealing between said tubular seal means and each of said first and said second carrier sleeve means.

6. A valve comprising:

tubular housing means for defining two regions;

said tubular housing means including a sealing surface facing one of said two regions;

said tubular housing means including lateral port means extending between said two regions and opening in said sealing surface;

valve mandrel means extending along said sealing surface and axially movable with respect to said tubular housing means between a first position and a second position;

tubular seal means carried by said valve mandrel means and expandable into engagement with said sealing surface and contractable away from said sealing surface;

said tubular seal means having one longitudinal extreme end on one side of said lateral port means and having another longitudinal extreme end on the other side of said lateral port means when said valve mandrel means is in its first position;

pressure responsive means for expanding said tubular seal means into engagement with said sealing surface and formed between said valve mandrel means and said tubular seal means;

said tubular seal means including means for admitting fluid into said pressure responsive means from the other of said two regions when said valve mandrel means is in its first position; and said tubular seal means being collapsed to a relaxed position contracted out of sealing engagement with said sealing surface when said valve mandrel means is in its second position.

7. The valve of claim 6 additionally including:

carrier means for carrying said tubular seal means on said valve mandrel means comprising:

first carrier sleeve means mounted on said valve mandrel means, and second carrier sleeve means mounted on said valve mandrel means;

wherein one longitudinal extreme end of said tubular seal means is mounted on one of said first and said second carrier sleeve means and the other longitudinal extreme end of said tubular seal means is mounted on the other of said first and said second carrier sleeve means.

8. The valve of claim 7 wherein:

one of said first and said second carrier sleeve means is fixed relative to said valve mandrel means;

the other of said first and said second carrier sleeve means is movable longitudinally with respect to said valve mandrel means;

additionally including means for resiliently urging said first and said second carrier sleeve means towards each other.

9. The valve of claim 7 additionally including:

anti-extrusion ring means secured to each of said one and said other extreme longitudinal end of said tubular seal means, each of said anti-extrusion ring means including a skewed surface for preventing extrusion of said tubular seal means off of said carrier sleeve means during relative movement of said first and said second carrier sleeve means.

10. The valve of claim 7 wherein:

said tubular seal means includes a reduced walled mid section, two enlarged walled end sections and orifice means in said mid section for admitting fluid into said pressure responsive means;

one of said two enlarged walled end sections is mounted around one of said first and said second carrier sleeve means and the other of said two enlarged walled end sections is mounted on the other of said first and said second carrier sleeve means; and additionally including seal means for sealing between said tubular seal means and each of said first and said second carrier sleeve means.

11. A valve comprising:

tubular housing means for defining two regions;

said tubular housing means including a radially inwardly facing sealing surface;

said tubular housing means including lateral port means extending between said two regions and opening in said sealing surface;

valve mandrel means extending along said sealing surface and longitudinally movable with respect to said tubular housing means between a first position and a second position;

tubular seal means carried by said valve mandrel means and expandable into sealing engagement with said sealing surface and when in a relaxed configuration contracted out of sealing engagement with said sealing surface;

said tubular seal means having one longitudinal extreme end on one side of said port means and having its other longitudinal extreme end on the other side of said port means when said valve mandrel means is in its first position;

pressure responsive means for expanding said tubular seal means into engagement with said sealing surface and formed between said valve mandrel means and said tubular seal means;

said tubular seal means including means for admitting fluid into said pressure responsive means;

said fluid admitting means extending laterally through said tubular seal means substantially midway between said one and said other longitudinal extreme end of said tubular seal means and, when said valve mandrel means is in its first position, being substantially aligned longitudinally with said lateral port means; and said pressure responsive means having an annular pressure responsive area transverse to the direction of movement of said valve mandrel means and having a cylindrical pressure responsive area substantially parallel to the direction of movement of said valve mandrel means and wherein said cylindrical pressure responsive area is maximized when said valve mandrel means is in said first position.

12. The valve of claim 11 wherein as said valve mandrel means moves from its first position towards its second position, the area of said cylindrical pressure responsive area reduces whereby the expanding force exerted on said tubular seal means by said pressure responsive means reduces and said tubular seal means is permitted to return to its relaxed configuration and thereafter said valve mandrel means completes its movement to its second position without frictional engagement between said tubular seal means and said sealing surface.

13. The valve of claim 11 additionally including:

carrier means for carrying said tubular seal means on said valve mandrel means comprising:

first carrier sleeve means mounted on said valve mandrel means, and second carrier sleeve means mounted on said valve mandrel means;

wherein one longitudinal extreme end of said tubular seal means is mounted on one of said first and said second carrier sleeve means and the other longitudinal extreme end of said tubular seal means is mounted on the other of said first and said second carrier sleeve means.

14. The valve of claim 13 wherein:

one of said first and said second carrier sleeve means is fixed relative to said valve mandrel means;

the other of said first and said second carrier sleeve means is movable longitudinally with respect to said valve mandrel means;

additionally including means for resiliently urging said first and said second carrier sleeve means towards each other.

15. The valve of claim 13 additionally including:

anti-extrusion ring means secured to each of said one and said other extreme longitudinal end of said tubular seal means, each of said anti-extrusion ring means including a skewed surface for preventing extrusion of said tubular seal means off of said carrier sleeve means.

16. The valve of claim 13 wherein:

said tubular seal means includes a reduced walled mid section, two enlarged walled end sections and orifice means in said mid section for admitting fluid into said pressure responsive means;

one of said two enlarged walled end sections is mounted around one of said first and said second carrier sleeve means and the other of said two enlarged walled end sections is mounted on the other of said first and said second carrier sleeve means; and additionally including seal means for sealing between said tubular seal means and each of said first and said second carrier sleeve means.

* * * * *